US006176330B1

(12) United States Patent
Burr

(10) Patent No.: US 6,176,330 B1
(45) Date of Patent: Jan. 23, 2001

(54) ROCK BIT FACE SEAL HAVING ANTI-ROTATION PINS

(75) Inventor: Bruce Hawley Burr, Houston, TX (US)

(73) Assignee: Camco International Inc., Houston, TX (US)

( * ) Notice: Under 35 U.S.C. 154(b), the term of this patent shall be extended for 0 days.

(21) Appl. No.: 09/417,041

(22) Filed: Oct. 12, 1999

(51) Int. Cl.[7] ..... E21B 10/22
(52) U.S. Cl. ..... 175/371; 277/379; 384/94
(58) Field of Search ..... 175/371, 372; 384/94; 277/336, 379, 385, 390, 396

(56) References Cited

U.S. PATENT DOCUMENTS

| | | | | |
|---|---|---|---|---|
| 2,650,842 | * | 9/1953 | Coopman | 277/387 |
| 3,162,452 | * | 12/1964 | Tankus | 277/396 |
| 3,761,145 | | 9/1973 | Schumacher, Jr. . | |
| 3,807,742 | * | 4/1974 | Hershey | 277/396 |
| 4,172,502 | | 10/1979 | van Nederveen . | |
| 4,199,156 | | 4/1980 | Oldham et al. . | |
| 4,215,870 | | 8/1980 | Escue . | |
| 4,261,582 | | 4/1981 | Womack . | |
| 4,299,398 | * | 11/1981 | Wahl | 277/336 |
| 4,359,111 | | 11/1982 | Gonzalez | 175/228 |
| 4,516,641 | | 5/1985 | Burr | 175/228 |
| 4,613,005 | | 9/1986 | Olsson | 175/371 |
| 4,629,338 | | 12/1986 | Ipplito | 384/94 |
| 4,838,365 | | 6/1989 | Kotch | 175/371 |
| 5,040,624 | | 8/1991 | Schumacher et al. | 175/371 |
| 5,080,378 | | 1/1992 | Kagawa . | |
| 5,295,549 | | 3/1994 | Dolezal et al. | 175/371 |
| 5,875,861 | * | 3/1999 | Daly et al. | 175/371 |
| 6,109,376 | * | 8/2000 | Pearce | 175/371 |

* cited by examiner

*Primary Examiner*—Hoang Dang
(74) *Attorney, Agent, or Firm*—Jeffery E. Daly

(57) ABSTRACT

The invention provides a mechanical face seal for rotary rock bits with a novel coil spring energization system that prevents yielding of the coil springs in extreme torque conditions. Within at least one of the coil springs is a cylindrical pin designed to co-act with the spring such that the combination becomes very stiff in the radial direction as the spring extends beyond a certain amount. This prevents the high torque from yielding the springs. When the spring returns to its normal extension, the pin does not interfere with the axial compression of the spring. This combination allows the coil spring energizers of a rotary rock bit mechanical face seal to survive the occasional extreme torque event.

17 Claims, 2 Drawing Sheets

ROCK BIT FACE SEAL HAVING ANTI-ROTATION PINS

BACKGROUND OF THE INVENTION

1. Field of the Invention

This invention provides an enhanced rotary face seal for roller cone rock bits. The new seal has pins which positively prevent rotation of the seal ring with respect to the seal ring carrier.

2. Description of the Related Art

Modern, premium roller cone rock bits utilize sealing systems to prevent the loss of lubricant from the roller cones. The seal system also prevents the abrasive laden drilling fluid outside the bit from entering into, and failing the bearing system of the rolling cones.

There are two basic types of sealing systems in common use in rolling cutter drill bits. In most drill bits, an elastomeric packing ring provides the seal between the rolling cone and the bearing system. These bits utilize an elastomeric compression type sealing system, and have adequate performance in most drilling applications. For rock bits used in very severe bit applications, however, rotary mechanical face seals are disposed between the rolling cone and the bearing to provide the seal.

Rotary mechanical face seals are generally made up of two flat sealing faces which are designed to maintain a thin film of lubricant between the sealing faces. As the sealing surfaces rotate relative to each other, they are urged together at a carefully controlled force by one or more energizers as shown for instance in U.S. Pat. Nos. 5,040,624, 4,838,365, and 3,761,145.

Although generally more expensive than elastomer seals, mechanical face seals are able to assure a level of performance in rock drilling bits which easily justifies the higher cost. Most mechanical face seals, also known as rigid face seals used in rotary rock bits are made from stainless steels and have sealing faces which are manufactured to be flat and smooth. These faces mate together to form a planar, annular sealing interface. These seals are usually made with one or two sealing rings with a gradually tapered shape adjacent to the sealing interface at the lubricant side. This creates a diverging geometry which provides preferential access for lubricant to enter into the sealing interface. As abrasives wear the outer periphery of the sealing interface, the diverging geometry also facilitates inward movement of the sealing interface to maintain the contact width.

Mechanical rigid face seals have become the seal of choice for rock bits used in the most severe drilling environments, due to the operating limitations of elastomers as dynamic seals. Rigid face seals are typically manufactured from materials which readily tolerate the thermal, chemical and mechanical attack of severe drilling environments. The seals provide a higher level of reliability than elastomer seals in rock bits and are capable of extremely long runs without significant loss of lubricant.

It is important to maintain a lubricant film between the two sealing faces. Oftentimes in operation, however, the film becomes too thin and frictional contact between the sealing faces will cause high torques on the seal faces. These high torques can cause failure of the systems which hold the seal in place. For instance, if elastomeric energizers are transmitting the torque, they may slip. A small amount of slippage can cause excessive wear on the elastomer energizers, leading to an early failure.

Even when coil spring energizers, such as shown in U.S. Pat. No. 4,838,365, are transmitting the torques, it is possible, under some circumstances for the coil spring energizers to fail. When the operating torques become too high, the shear forces on the coil springs can cause them to yield. Once any one of the springs yield, the seal assembly loses its ability to move in response to volume changes in the lubricant near the seal, leading to rapid seal failure. The key to the proper operation of rigid face seals for rolling cutter drill bits lies in their ability to accommodate the lubricant volume changes near the seal, as described in U.S. Pat. No. 4,516,641. In non-rock bit applications, rigid face seals do not have to deal with this peculiar volume compensation problem. The unique design requirements for rock bit volume compensating rigid face seals are such that they are in a unique class of rigid face seals. There are many superficial similarities between volume compensating rigid face seals for rock bits and non-rock bit face seals. However, the diverging design requirements of the two groups tend to make them non-analogous.

For example, coil springs are often used in rigid face seal applications other than for rolling cutter drill bits. To prevent torque from being applied to the springs, a plurality of pins are often interspersed with the coil springs. These pins allow free axial movement of the seal faces while transmitting all the face torque. It is undesirable in these designs for the springs to carry any part of the face torque because torque loading can profoundly affect the springs' ability to energize the seal faces. The wire coil of the spring may bind or 'hang' against the comer of the spring bore, changing the springs' force/deflection characteristics.

A non-rock bit face seal design incorporating coil springs for energizers and pins for torque transmission is disclosed in U.S. Pat. No. 4,261,582, herein incorporated by reference. The pins and their mating bores typically have diameters sized such that all the torque load is transmitted from the seal rings through the pins. No torque is carried by the coil springs. Even in designs where pins and springs are combined, as shown in U.S. Pat. Nos. 4,215,870 and 5,080,378, the components are arranged such that the springs never transmit any of the torque load from the seal ring.

In all the prior non-rock bit mechanical face seal designs known to the inventor of the present invention, great care is taken to assure that no torque is carried by coil spring energizers.

In rock bits, however, coil spring energizers are able to successfully carry torque. The events which normally lead to high face torques in volume compensating face seals in rock bits also tend to relieve the coil springs of their energization duties during these events. This happens because the pressure force on the seal face during an 'onward loading' volume compensating event causes the springs to extend and also causes the axial face load to increase. Under this condition, the force contribution from the spring is not necessary for an effective seal of the seal faces. As soon as the event is past, the face torque rapidly decreases as the springs retract. When the pressures are finally balanced, the spring returns to its centered position.

The coil spring is designed such that the thickness of the wire in the coil is greater than the gap between the seal and the cutter bore when the spring is in its centered position. This prevents the wire from 'hanging' on the lip of the spring cavity in the cutter from normal operating torques.

However, it has been observed that face torques may sometimes exceed 200 inch-pounds in these bits. At this torque level, the wire in coils can yield, effectively disabling the spring as an energizer. The present invention provides a means to prevent this spring yielding.

SUMMARY OF THE INVENTION

The present invention provides a rigid face seal for rotary rock bits with a novel coil spring energization system that prevents yielding of the coil springs in extreme torque conditions. Within at least one of the coil springs is a cylindrical pin designed to co-act with the spring such that the combination becomes very stiff in the radial direction as the spring extends beyond a certain amount. This prevents the high torque from yielding the springs. When the spring returns to its normal extension, the pin does not interfere with the axial compression of the spring. This combination allows the coil spring energizers of a rotary rock bit rigid face seal to survive the occasional extreme torque event.

As the rigid face seal assembly operates within the rolling cutter rock bit, the seal assembly moves axially with respect to the roller cutter, causing the coil springs to extend or compress. The coil spring is vulnerable to yielding only when it is extended enough to leave one loop of the coil unsupported. Because the coil spring often extends enough to leave a coil loop unsupported, the torque on the seal faces transmitted through the coil springs can cause the coil springs to yield.

The inside diameter of a coil springs tends to get smaller as the spring extends and grow larger as it compresses. In the present invention, a cylindrical pin is installed within a coil spring energizer for a rigid face mechanical seal for rolling cutter drill bits. The pin and spring are sized such that as the spring extends and the seal face torque increases, the spring and pin co-act to be very stiff radially. When the spring returns to its original extension, the pin is released, allowing the spring to operate unencumbered by the pin.

In its broadest form the invention is a rolling cutter rock drill bit for drilling boreholes into the earth with at least one rolling cutter mounted upon a cantilevered bearing shaft. A lubricant is disposed between the rolling cutter and the cantilevered bearing shaft. A rigid face seal assembly is mounted between the rolling cutter and the bearing journal to seal the lubricant within the rolling cutter. The rigid face seal assembly is made with at least one rigid seal ring and a plurality of coil spring energizers disposed upon the seal ring. A cylindrical pin is disposed within one or more of the coil spring energizers. The outside diameter of the pin is just slightly smaller than the inside diameter of the coil spring when the face seal is assembled at equilibrium. This allows the spring and the pin to be independent of each other. However, when the spring extends and the torque on the seal faces increase, the pin and spring co-act to become stiff and transmit very high torques without damage to the coil spring.

DETAILED DESCRIPTION OF THE INVENTION AND THE PREFERED EMBODIMENTS

Figure 1:
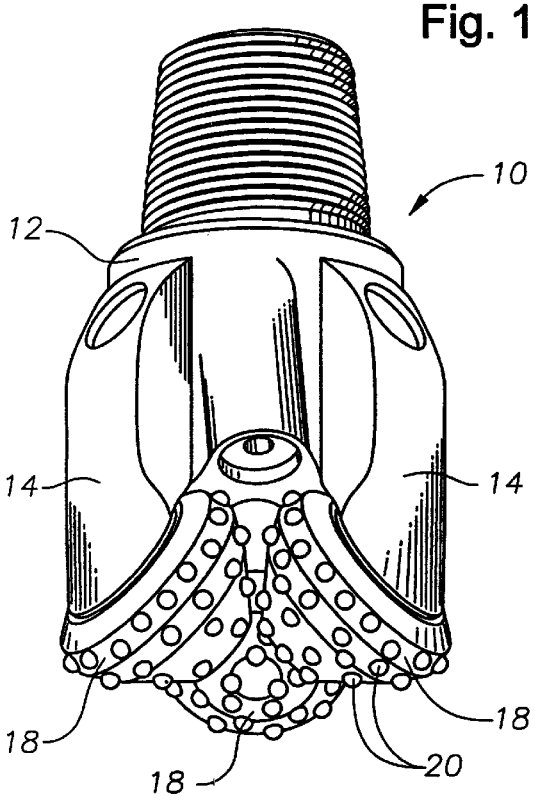
FIG. 1 is a perspective view of a typical rolling cutter drill bit.
Figure 2:
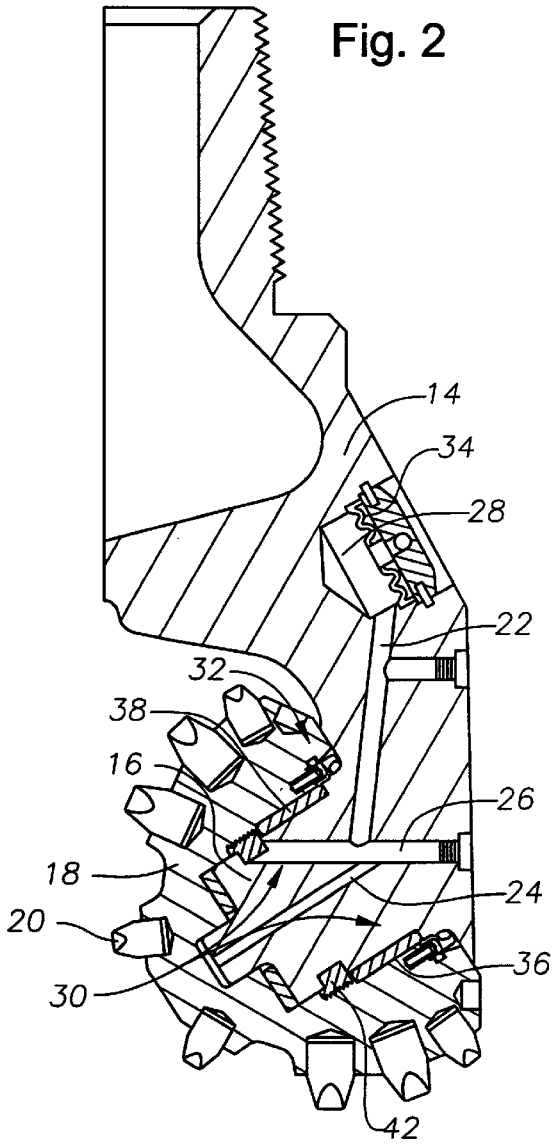
FIG. 2 is a cross section view through one leg of a rolling cutter drill bit with a rigid face seal assembly of the preferred embodiment of the present invention.

Referring now to the drawings in more detail, and particularly to FIGS. 1 and 2. A rolling cutter rock drilling bit 10 includes a body 12 with a plurality of leg portions 14. A rolling cutter rock drilling bit 10 is also commonly called a rock bit, a rolling cutter drill bit or an oilfield drill bit. A cantilevered bearing shaft 16 formed on each leg 14 extends inwardly and downwardly. A rolling cutter 18 is rotatably mounted upon the shaft 16. Attached to the rolling cutter 18 are hard, wear resistant cutting inserts 20 which engage the earth to effect a drilling action and cause rotation of the rolling cutter 18. A friction bearing member 36 is mounted between the bearing shaft 16 and a mating bearing cavity 38 formed in the cutter 18. This friction bearing 36 is designed to carry the radial loads imposed upon the cutter 18 during drilling. A retention bearing member 42 is mounted in the cutter 18 to retain the cutter 18 upon the bearing shaft 16 during drilling.

Internal passageways 22, 24, & 26, as well as a reservoir 28 and bearing area 30 of the leg 14, are filled with lubricant (not shown) during bit assembly. The lubricant helps reduce bearing friction and wear during bit operation and is dynamically sealed within the cutter 18 by a rigid face seal assembly 32.

The pressure balancing diaphragm 34 equalizes the pressure between the drilling fluid and the lubricant and typically has a built in pressure relief means which releases lubricant into the drilling fluid when a predetermined pressure differential is reached. This is intended to protect the bearing seal 32 and pressure balancing diaphragm 34 against unintended rupture or damage.

Figure 3:
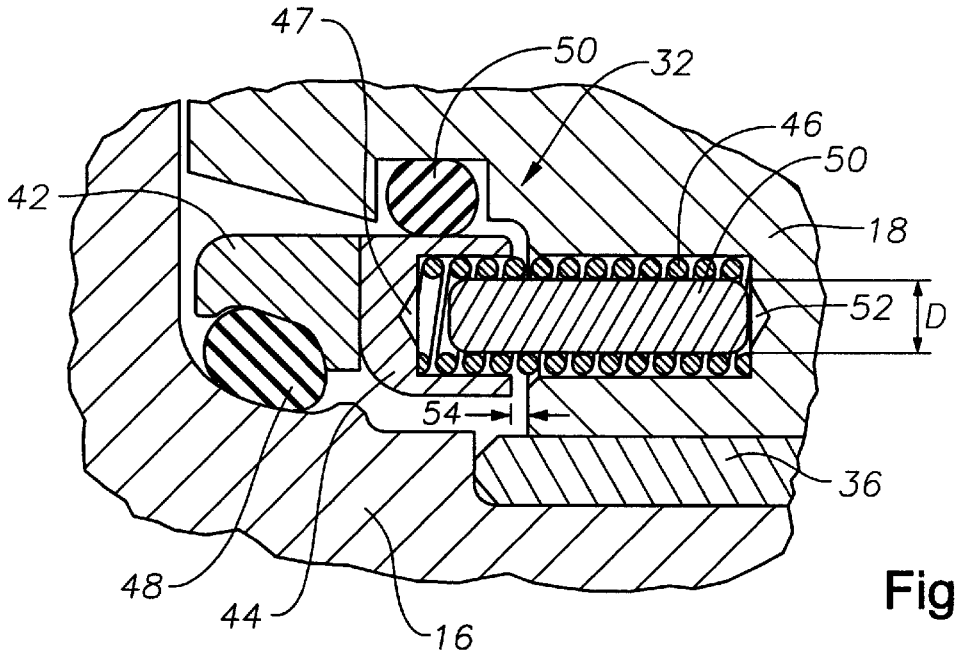
FIG. 3 is an enlarged cross section view of the preferred embodiment seal assembly shown in FIG. 2.
Figure 4:
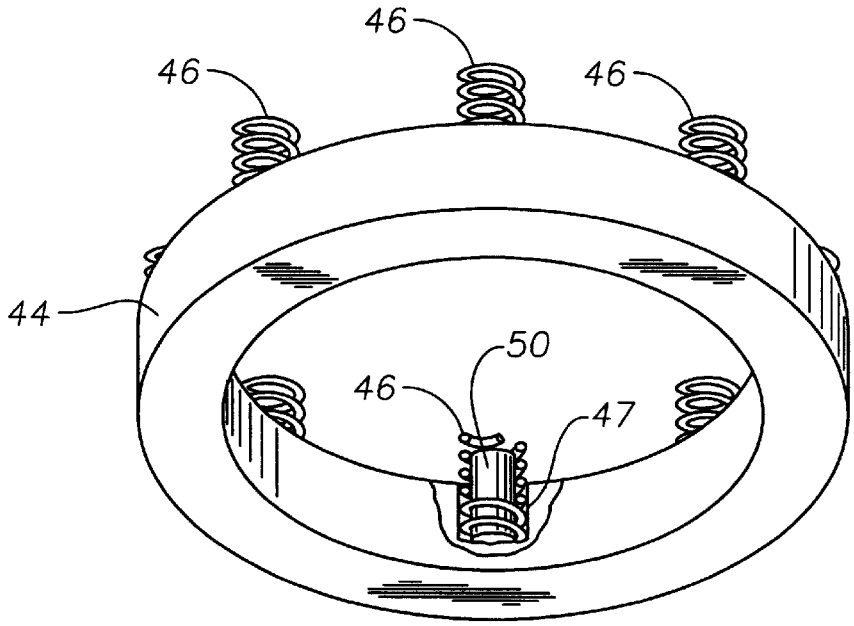
FIG. 4 is a perspective view of one of the mechanical face seal rings of the preferred embodiment.

Referring now to FIG. 3, the mechanical rigid face seal assembly 32 is comprised of two seal rings 42, 44 which are preferably formed of AISI 440C (UNS S44004) stainless steel, although many other materials are also suitable. Seal ring 42 is sealed with the bearing shaft 16 and also energized against its mating seal ring 44 by an elastomer ring 48. Since seal ring 42 does not rotate with respect to the bearing shaft 16 under normal operating conditions it is considered the stationary seal ring.

The rotating seal ring 44 is mounted within the cutter 18. This ring 44 is energized by a number of coil springs 46. An elastomer seal 50 prevents fluids from bypassing the rotating seal ring 44 while allowing the seal ring 44 to move axially.

A least one pin 50, but preferably two pins 50 are disposed within a corresponding coil spring. If more than one pin is utilized it is preferred they be placed within springs that are symmetrically arranged in a diametrically opposed manner on the rigid face seal assembly 32 so that the torque forces are evenly transmitted from the seal ring 44, through the springs 46 with pins 50.

The following dimensions are typical for a coil spring energized rigid face seal for a 12¼ inch diameter rolling cutter drill bit. Other bit sizes may have differently sized sealing elements, so the dimensional and physical properties indicated are presented below for example only.

The rotating seal ring 44 is forced against the stationary ring 42 by a series of twelve coil spring energizers 46, spaced around the circumference of the ring 44 to apply load at discrete locations. Each coil spring 46 is about 0.175 inches outside diameter and 0.111 inches inside diameter in its free state. In the assembled position as shown in FIG. 3, the outside diameter of the spring 46 grows slightly to about 0.179 inches, and the inside diameter grows to about 0.115 inches. The springs 46 are compressed so that each spring exerts about 7.5 pounds force onto the rotating ring 44 at assembly. Since there are twelve springs, the assembled face load is about 90 pounds.

The wire of the coil spring 46 is about 0.032 inches in diameter, and the clearance gap 54 between the cutter body 18 and the seal ring 44 is nominally 0.025 inches at assembly. Therefore, during normal operation, the wire of the coil spring 46 cannot be moved through the clearance gap 54 and cause yielding of the spring 46.

The recesses 47 in the rotating seal ring 44 are each about 0.188 inches in diameter and about 0.142 inches in depth, not counting the drill point.

The recesses 52 in the cutter 18 are each also about 0.188 inches in diameter and about 0.340 inches in depth not counting the drill point. At least some of the recesses 52 in the cutter 18 are aligned generally axially with recesses 47 in the rotating seal ring 44. A plurality of the coil springs 46 are disposed within the aligned recesses 47, 52. The combined depth of the ring recess 47 and the cutter recess 52 is about 0.482 inches.

The pins 50 each have a diameter D of about 0.112 inches and are about 0.462 inches in length. The exact length of the pin is not critical provided that it is somewhat longer than the sum of depth of recess 52 and the gap 54 and less than the combined depth of the two recesses 47 and 52 so the pin 50 does not stop the seal ring 44 from contacting the cutter body 18 when the springs 46 are fully compressed. The pins 50 are smooth and have rounded ends so that they do not interfere with the normal axial movement of the springs 46 during normal operation.

The centers of the coil spring energizers 46 are positioned at a diameter of about 3.218 inches, which is smaller than the 3.350 inch innermost diameter of the sealing interface.

As can be appreciated by the above dimensional data, as the spring 46 extends during extraordinary volume compensation events while in operation it can grip upon the pin 50. This helps the spring 46 and pin 50 to co-act as a single element when extreme volume compensation movement of the seal assembly 32 causes maximum extension of the spring 46. This event is also typically a high torque event.

During high torque events, the co-action of the spring 46 and pin 50 allows high torques to be transmitted through the spring 46 without damage. When the springs are not extended (as in normal operation), the wire of the springs 46 is too large to pass into the clearance gap 54 between the seal ring 44 and the cutter 18. There is sufficient clearance between the pin 50 and the inside diameter of the coil spring 46 in normal operation so that the spring 46 and the pin 50 do not interact.

Although only one pin is required to successfully practice this invention, it is preferred to have two pins positioned in diametrically opposite locations on the seal ring 44 so that the torque will be transmitted evenly. However, it is contemplated that any symmetrical arrangement of coil springs 46 with pins 50 inside would be effective in transmitting the torque without damage.

The advantages of the embodiments of this invention are that the mechanical seal ring 44 mounted within the cutter 18 is positively prevented from rotation within the cutter 18 without damage to the spring 46 and without affecting its axial movement in normal operation.

It would be readily apparent to one skilled in the art that there are many other combinations of seal rings 44 and coil spring energizers 46 and pins 50 which can be made and yet do not depart from the scope of the present invention. For instance a single energizer face seal could be manufactured with coil springs 46 and pins 50 which would effectively transmit high torques without allowing yielding of the coil springs.

Whereas the present invention has been described in particular relation to the drawings attached hereto, it should be understood that other and further modifications apart from those shown or suggested herein, may be made within the scope and spirit of the present invention.

What is claimed is:

1. A rolling cutter rock drill bit for drilling boreholes into the earth comprising:

at least one rolling cutter mounted upon a cantilevered bearing shaft;

a lubricant disposed between the rolling cutter and the cantilevered bearing shaft, a plurality of first recesses formed in the rolling cutter;

a rigid face seal assembly mounted between the rolling cutter and the bearing journal to seal the lubricant within the rolling cutter, the rigid face seal assembly comprising at least one seal ring, a plurality of second recesses in the seal ring, the plurality of the second recesses aligned generally axially with the plurality of the first recesses in the rolling cutter, and a plurality of coil spring energizers disposed within the aligned first and the second recesses, wherein a pin is disposed within at least one of the coil spring energizers disposed within the plurality of aligned first and second recesses.

2. The rolling cutter rock drill bit of claim 1 wherein the coil spring energizers are formed of a wire with a diameter and wherein upon assembly a clearance gap between the seal ring and the rolling cutter is less than the diameter of the wire.

3. The rolling cutter rock drill bit of claim 2 wherein the wire has a diameter of about 0.032 inches.

4. The rolling cutter rock drill bit of claim 2 wherein the clearance gap has a width of about 0.025 inches.

5. The rolling cutter rock drill bit of claim 1 wherein the plurality of first recesses formed in the rolling cutter have a diameter of about 0.188 inches and a depth of about 0.340 inches.

6. The rolling cutter rock drill bit of claim 1 wherein the second recesses in the seal ring have a diameter of about 0.188 inches and a depth of about 0.142 inches.

7. The rolling cutter rock drill bit of claim 1 wherein the pins have a diameter of about 0.112 inches and have a length of about 0.462 inches.

8. The rolling cutter rock drill bit of claim 1 wherein the rigid face seal assembly comprises two said pins, the first pin disposed within a first coil spring energizer, and the second pin disposed within a second coil spring energizer, the first and second coil spring energizers arranged in a diametrically opposed manner on the rigid face seal assembly.

9. A rigid face seal for a rolling cutter rock drill bit for drilling boreholes into the earth, the rolling cutter rock drill bit comprising at least one rolling cutter mounted upon a cantilevered bearing shaft, a lubricant disposed between the rolling cutter and the cantilevered bearing shaft, and a plurality of first recesses formed in the rolling cutter;

the rigid face seal comprising at least one seal ring, a plurality of second recesses in the seal ring, the plurality of the second recesses in the seal ring aligned generally axially with the plurality of the first recesses in the rolling cutter, a plurality of coil spring energizers disposed within the plurality of aligned first and the second recesses and a pin disposed within at least one of the coil spring energizers disposed within the plurality of aligned first and second recesses;

wherein the pin has a diameter D and the coil spring energizer has a free uncompressed first inside diameter less than D and a second compressed inside diameter which, upon assembly, is greater than D.

10. The rigid face seal of claim 9 wherein during operation the coil spring energizer and the pin are configured such that the pin is free to move within the coil spring energizer during normal operation and grip upon the pin to co-act as a single element with the pin when an extreme volume compensation movement of the rigid face seal causes a maximum extension of the coil spring energizer.

11. The rigid face seal of claim 9 wherein the coil spring energizers are formed of a wire with a diameter and wherein upon assembly a clearance gap between the seal ring and the rolling cutter is less than the diameter of the wire.

12. The rigid face seal of claim 11 wherein the wire has a diameter of about 0.032 inches.

13. The rigid face seal of claim 11 wherein the clearance gap has a width of about 0.025 inches.

14. The rigid face seal of claim 9 wherein the plurality of first recesses formed in the rolling cutter have a diameter of about 0.188 inches and a depth of about 0.340 inches.

15. The rigid face seal of claim 9 wherein the second recesses in the seal ring have a diameter of about 0.188 inches and a depth of about 0.142 inches.

16. The rigid face seal of claim 9 wherein the pin has a diameter of about 0.112 inches and have a length of about 0.462 inches.

17. The rigid face seal of claim 9 wherein the rigid face seal assembly comprises two said pins, the first pin disposed within a first coil spring energizer, and the second pin disposed within a second coil spring energizer, the first and second coil spring energizers arranged in a diametrically opposed manner on the rigid face seal assembly.

* * * * *